United States Patent [19]

Hinchman et al.

[11] 4,007,591

[45] Feb. 15, 1977

[54] POWER DEVICE

[75] Inventors: Leslie R. Hinchman; Robert B. Hinchman, both of San Benito, Tex.

[73] Assignee: Bessie L. Caldwell, San Benito, Tex.; a part interest

[22] Filed: May 16, 1975

[21] Appl. No.: 578,164

[52] U.S. Cl. ..... 60/325; 60/494; 60/DIG. 2; 415/202

[51] Int. Cl.[2] ..... F15B 15/18

[58] Field of Search ..... 60/325, 477, 494, DIG. 2, 60/DIG. 10, 39.44; 180/44 F, 66 R; 415/92, 202, 203

[56] References Cited

UNITED STATES PATENTS

| | | | |
|---|---|---|---|
| 1,068,596 | 7/1913 | Long | 415/92 X |
| 1,448,893 | 3/1923 | Wiki | 415/202 |
| 3,828,880 | 8/1974 | Smith | 60/325 |

FOREIGN PATENTS OR APPLICATIONS

| | | | |
|---|---|---|---|
| 6,175 | 12/1894 | Sweden | 60/325 |

*Primary Examiner*—Edgar W. Geoghegan
*Attorney, Agent, or Firm*—Clarence A. O'Brien; Harvey B. Jacobson

[57] ABSTRACT

A power device utilizing a housing and rotor assembly receiving pressurized, non-compressible liquid from a pump for driving an output shaft which may be employed for many purposes. The housing is communicated with and positioned on top of the tank or sump for the liquid and the pump includes an intake associated with the tank for circulating the liquid which may be in the form of an oil, such as that used as transmission fluid, or the like. A bypass control is provided for the pump for varying the output characteristics of the shaft and a DC electric motor drives the pump. The electric motor is associated with an electric power system for providing electrical energy to the pump motor which includes an alternator or equivalent charging device, battery assembly and an inverter and convertor, in one embodiment, associated in a manner to supply sufficient electrical energy to the pump motor for driving the pump.

5 Claims, 8 Drawing Figures

Pump
Motor
Alternator
Charger

Pump
Motor
Converter

POWER DEVICE

BACKGROUND OF THE INVENTION

1. Field of the Invention

The present invention generally relates to power devices and more particularly a device utilizing a DC electric motor and pump assembly associated with a hydraulic fluid supply and a rotary hydraulic motor including a unique housing, rotor and gearing assembly associated with the supply reservoir for the circulating liquid for producing output torque on a drive shaft combined with an electrical assembly for supplying electrical energy to the DC motor.

2. Description of the Prior Art

Devices utilizing hydraulic motors or turbine-like devices for converting energy in a pressurized hydraulic liquid to mechanical energy have been used as has various types of engines or other means for supplying pressurized hydraulic fluid. While such devices have received some degree of acceptance, such devices usually employ an engine which utilizes gasoline, Diesel fuel or other combustible materials and, in some instances, are relatively inefficient in converting energy into mechanical output.

SUMMARY OF THE INVENTION

An object of the present invention is to provide a power device incorporating a housing and rotor assembly disposed therein associated with a pump and motor unit for supplying pressurized, non-compressible hydraulic fluid for discharge onto the pocketed periphery of the rotor in angular direction and in offset relation to the center of the rotor for driving the rotor with the housing being disposed above and supported from a reservoir or tank for the fluid thereby providing an effective circulation of the hydraulic fluid.

Another object of the invention is to provide a power device in which the pump is powered by a DC electric motor and provided with a bypass assembly for controlling the output characteristics of the rotor shaft.

Still another object of the invention is to provide a power device in accordance with the preceding objects in which the rotor housing is provided with an injector block therein having one surface conforming with the periphery of the rotor for sealing contact therewith and provided with a discharge orifice for discharging pressurized fluid onto the rotor.

A further important object of the invention is to provide a power device in accordance with the preceding objects together with an electrical system for supplying electrical energy to the DC motor including a battery assembly and a battery charging assembly connected with the output of the rotor for maintaining a charge in the battery assembly together with an inverter and convertor assembly for efficiently supplying electrical energy to the DC pump motor.

Still another important feature of the invention resides in the provision of a power device which is efficient in operation, relatively maintenance free, quite easily controlled and relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
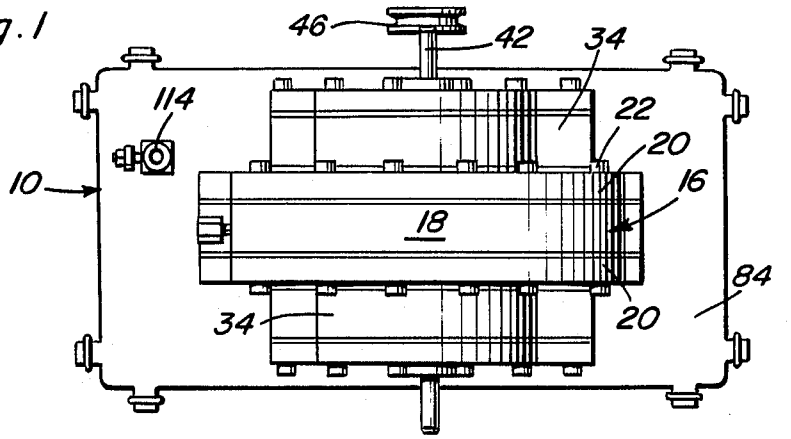
FIG. 1 is a top plan view of the power device of the present invention with the electrical system and motor and pump unit removed therefrom.

Referring now specifically to the drawings, the power device of the present invention is designated generally by reference numeral 10 and includes a motor and pump assembly generally designated by the numeral 12 for supplying pressurized hydraulic fluid to the power device 10 and an electrical assembly generally designated by numeral 14 for supplying electrical energy to the motor and pump assembly 12.

The power device 10 includes a stationary housing or casing 16 including a central section 18 and a pair of side plates 20 secured together by through bolts 22 with suitable gaskets being provided for sealing the interior of the casing or housing and defining a hollow chamber 24 therein in which a circular rotor 26 is disposed. The circular rotor 26 is supported by a shaft 28 which is drivingly connected thereto by a flange-type coupling 30 with the shaft 28 being journaled in suitable bearings 32 provided in the side plates 20. A gear casing 34 is provided on each side of the housing 16 and includes a hollow interior cavity 36 receiving a pinion gear 38 on the shaft 28 and a driven gear or bull gear 40 on a drive shaft 42 that is journaled in suitable bearings 44 carried by the gear casing 34. The shaft 42 is provided with a pulley, gear or other mechanism 46 by which the output torque from the power device may be utilized to drive any desired apparatus or device. The shaft 42 may be provided with a fly wheel and connected to a transmission or other mechanical device to facilitate use of the power output.

The rotor 26 has a pair of peripheral edge recesses defining peripheral shoulders 48 thereon and a plurality of peripherally spaced pockets 50 which are of substantially tear drop configuration and include a leading edge abutment wall 52 generally paralleling the radius of the rotor and the trailing portion of the pockets tapering upwardly to the periphery of the rotor and the transverse dimensions of the pockets also tapering and curving gradually inwardly to a point of tangency with the periphery of the rotor thus providing a plurality of closely spaced, peripherally arranged and circumferentially aligned pockets in the periphery of the rotor.

Figure 2:
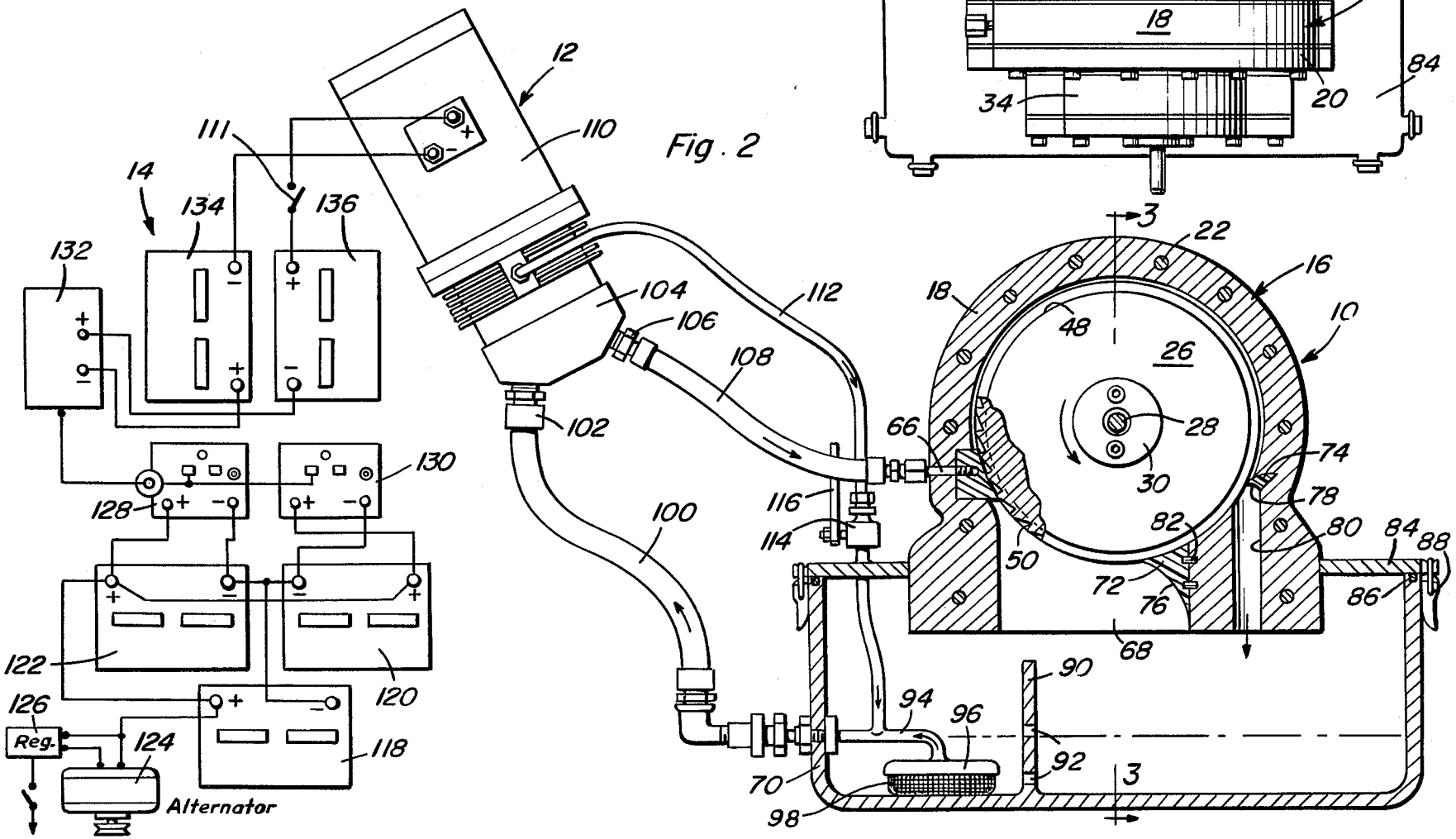
FIG. 2 is a sectional view of the housing, a portion of the rotor and associated tank with the pump and electrical assembly being diagrammatically illustrated in association therewith.
Figures 3, 4, 5, 6, 7, 8:
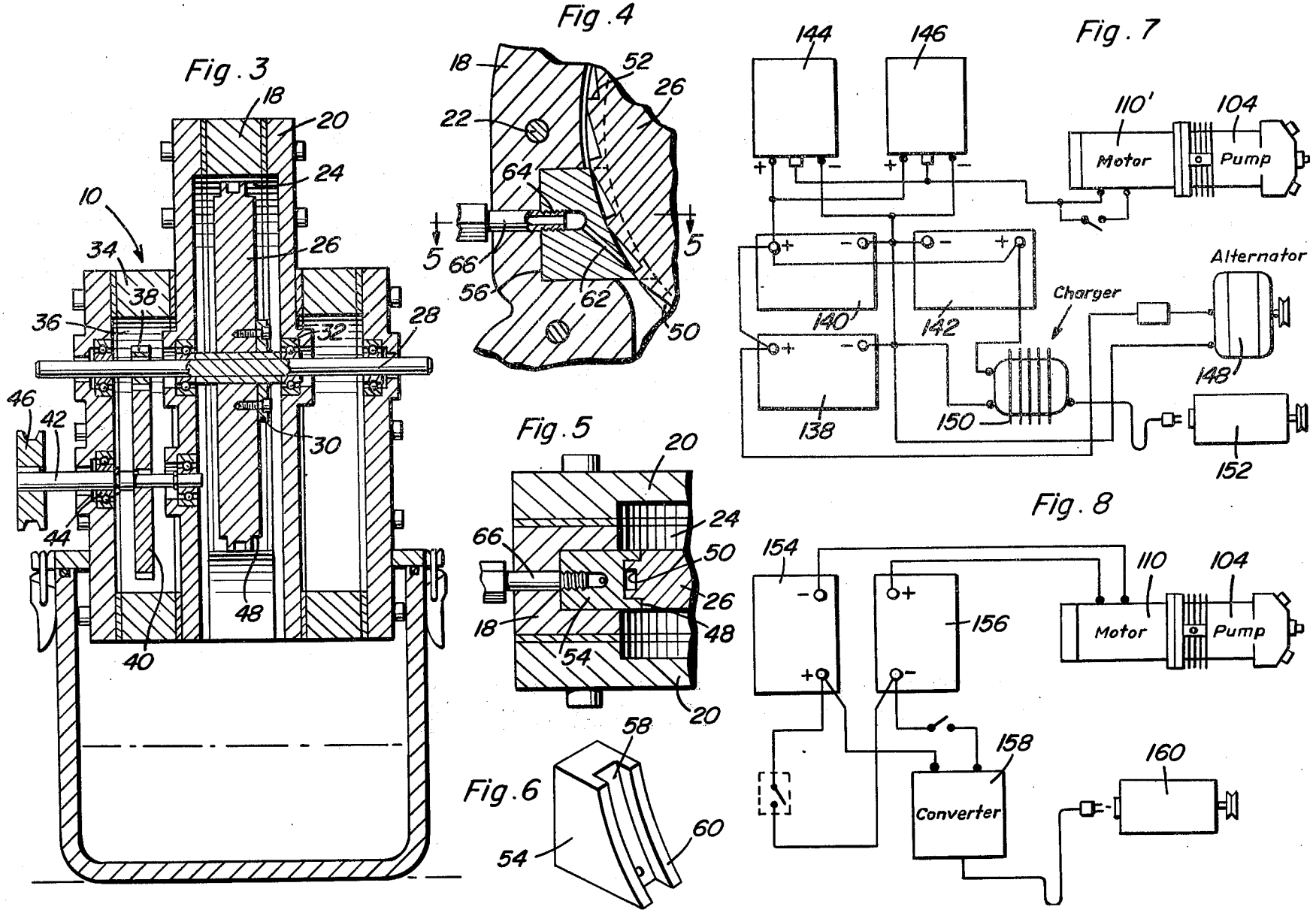
FIG. 3 is a vertical, sectional view of the power device illustrating the association of the components.
FIG. 4 is a fragmental, sectional view of the injector block and associated portion of the rotor and housing, on an enlarged scale, illustrating the structural association of these components.
FIG. 5 is a detailed sectional view taken substantially upon a plane passing along section line 5—5 of FIG. 4 illustrating further structural details of this assembly.
FIG. 6 is a perspective view of the injector block.
FIG. 7 is a schematic view of the motor pump unit and a second embodiment of the electrical arrangement for supplying electrical energy to the DC motor.
FIG. 8 is a schematic view, similar to FIG. 7, but illustrating another embodiment of the electrical arrangement.

The housing 16 is provided with an injector block 54 received within a recess 56 in the interior of the center section 18 of the housing, as illustrated in FIGS. 4 and 5, with the injector block being disposed in the lower quadrant of the housing, below the shaft 28, as illustrated in FIG. 2. The inner surface of the injector block 54 is provided with an arcuate channel 58 defined by a pair of arcuate ribs or side edge portions 60 which conform with and engage the periphery of the rotor 26, as illustrated in FIG. 5, that is, with the channel 58 receiving the portion of the rotor having the pocket 50 therein and the ribs 60 being received against the shoulders 48 so that the injector block more or less sealingly engages the periphery of the rotor. Also, the injector block has a discharge orifice or passageway 62 communicating with the groove or channel 58 adjacent the lower edge and angulated downwardly so that as the abutment face 52 of each pocket passes the discharge end of the orifice 62, the orifice or passageway 62 is substantially perpendicular thereto. The central portion of the block is provided with a threaded passageway 64 communicating with the discharge orifice 62 and threadedly receiving an inlet conduit 66 having a shoulder thereon which will secure the injector block in position when the shoulder engages the exterior of the central portion 18 of the housing 16 thus retaining the injector block in position.

The lower portion of the central annular member 18 is provided with a downwardly opening discharge area 68 communicating with the upper end portion of a tank or reservoir 70 which receives a quantity of circulating fluid which is discharged from the rotor down through the discharge opening 68. Any of the circulating fluid tending to cling to the periphery of the rotor will be wiped therefrom by wipers 72 and 74, as illustrated in FIG. 2. The wiper 72 has an arcuately curved surface 76 deflecting circulating fluid downwardly through the discharge opening 68 and the wiper 74 is smaller and provided with a shorter arcuate surface 78 for directing circulating fluid down through a passageway 80 which communicates with the tank 70. The wipers 72 and 74 conform with the shape of the rotor and may be constructed of plastic material having wear resistant characteristics, such as "Teflon", or the like. The wipers 72 may be secured in place by suitable bonding agent, such as an epoxy resin, and dowels may be employed as indicated at 82.

The tank 70 is secured to a top plate 84 rigid with the housing 16 and the tank may be secured in sealed relation by a peripheral O-ring seal 86 and suitable overcenter fastener devices 88 to enable disconnection of the tank 70 when desired for maintenance or cleaning. Also, the tank 70 is provided with an upstanding baffle 90 therein having aperatures 92 therethrough which enables the hydraulic fluid to seek its own level but eliminates excessive displacement, such as might occur if the power device is mounted in a vehicle of some type. The tank 70 also is provided with a suction or intake pipe 94 provided with an intake adapter 96 with a screen 98 thereon adjacent the bottom of the tank for intake of circulating fluid through a conduit 100 which is communicated with the inlet or intake side 102 of a pump 104 which has a discharge or outlet 106 communicated with the pipe 66 through a conduit 108 thereby providing a path for circulation for the hydraulic fluid from the tank 70 through the pump 104, through the discharge orifice 62 for impingement on the pockets 50 in the turbine and subsequent gravity discharge back to the tank 70 with the rotor 26 being rotatably driven in a counterclockwise direction, as viewed in FIG. 2. The pump 104 is driven by a DC electric motor 110 and combines with the pump 104 to form the motor pump assembly 12. The discharge characteristics of the pump 104 will be controlled by a bypass line 112 extending from the pump 104 back to the intake line 94 in the tank 70 with the bypass line 112 being provided with a control valve 114 having a handle 116 or other suitable control device attached thereto to vary the bypass flow from the pump so that the output characteristics of the pump may be controlled. The pump 104 is any suitable type of positive displacement pump, such as a gear-type pump, vane pump, or the like, having the requisite volume and pressure characteristics depending upon the dimensional characteristics of the power device and the output desired therefrom.

In one embodiment of the invention, a rotor diameter of 8 inches has been employed with the housing being correspondingly dimensioned, a pump having an output capability of 1,500 psi, driven by a 24 volt DC motor whereby a rotor having a ½ inch thickness is driven at a speed of 8,500 rpm with it being pointed our that the dimensions and rotational characteristics of the power device may be varied depending upon the requirements for each installation. The hydraulic fluid being employed may be any suitable type of liquid having lubrication characteristics such as transmission fluid, lightweight lubricating oil, and the like, and all of the rotational components may be provided with suitable bearings of any desired type having requisite lubrication characteristics.

The electrical assembly 14 includes three storage batteries 118, 120 and 122 provided with an alternator 124 driven from the power pulley 46 and a suitable regulator 126 for charging the batteries in a conventional and well known manner. The batteries are connected in series and are connected to the terminals of a pair of inverters 128 and 130, as illustrated in FIG. 2.

The output from the two invertors 128 and 130 is connected to a convertor 132 with the two output terminals thereof connected to the terminals of a pair of batteries 134 and 136 with the negative terminal of the convertor connected to the positive terminal of the battery 134 and the positive terminal of the convertor 132 connected to the negative terminal of battery 136. The negative terminal of the battery 134 is connected to the negative terminal of the DC motor and the positive terminal of battery 136 is connected to the positive terminal of the DC motor 110.

In the embodiment illustrated in FIG. 7, an AC motor 110' is used and in this arrangement, the three batteries 138, 140 and 142 are connected to a pair of inverters 144 and 146 which are connected to the AC motor 110' and in this arrangement, an alternator 148 is used to charge the batteries or, in lieu thereof, a charger 150 may be employed which can be plugged into an AC source or connected with an AC generating device 152 with either the alternator 148 or the AC generating device 152 connected with the output shaft pulley 46.

FIG. 8 illustrates a further simplified form of electrical arrangement in which the motor 110 is a DC motor and is connected to a pair of batteries 154 and 156 which in turn are connected to a convertor 158 capable of being plugged into an AC charger or connected with an AC generator 160 similar to and driven in the same manner as the generator 152 with suitable switch controls being provided for connecting the convertor to the batteries and connecting the batteries to each other.

In the arrangement illustrated in FIG. 2, the inverters 128 and 130 utilize 12 volts and 25 amps from the batteries and provide a 115 voltage input to the convertor 132 and the batteries 134 and 136 which act as cushion or surge devices receive 28 volts DC and 80 amps. with the motor 110 being a 24 volt and 52 amps motor. The alternator 124 is a 12 volt 40 amp. alternator and is powered by the motor or power device 10 and will maintain the batteries charged thus supplying electrical energy to the motor.

In each embodiment of the invention, when the switch 111 connecting the DC drive motor 110 to its source of electrical energy is closed, the pump will be driven thus causing the motor to operate for providing a power output which operates and will continue as long as the motor is connected to a source of electrical energy in which the alternator recharges the batteries and maintains operation thereof over an extended period of time. This is believed due to the utilization of the inverters which convert the DC electrical power from the batteries to AC electrical power in the convertor and the convertor which converts the AC electrical power to DC electrical power. The inverters and convertor and the batteries, alternator, regulator and switches are standard, conventional electrical components available commercially. When the batteries become discharged, they are charged by being connected to a source of electrical energy, such as household current, or the like, with a suitable charging device being utilized for recharging the batteries as may be required.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A power device comprising a housing having a circular chamber therein, a rotor journaled in said housing and being of circular configuration and provided with a plurality of circumferentially spaced pockets on the periphery thereof, said housing including a hydraulic fluid inlet associated therewith for impinging pressurized hydraulic fluid onto said rotor, said housing including a discharge opening for hydraulic fluid at the bottom thereof for gravity discharge of hydraulic fluid after it impinges against the rotor and causes rotation of the rotor, a reservoir tank for the hydraulic fluid disposed below said housing and receiving hydraulic fluid therefrom, pump means having an intake communicated with the tank and an outlet communicated with the inlet in the housing for circulating hydraulic fluid from the tank into the housing under pressure, said pump means including an electric motor connected therewith, and an electrical assembly for supplying electrical energy to said pump motor, said rotor including drive means associated therewith extending externally of the housing for connection with a device for utilizing the rotational output from the rotor, said housing including an injector block having an inner surface sealingly engaged with the periphery of the rotor, said injector block including a discharge orifice therethrough communicating with the pump means, said rotor having peripheral edge shoulders, said injector block having spaced ribs engaging the shoulders and a central channel receiving the portion of the rotor between the shoulders, said pockets in the motor being generally tapered in configuration and provided with an abutment wall in the leading end thereof disposed in substantially perpendicular relation to the orifice as the pocket passes the orifice, said injector block being disposed below the horizontal center of the rotor for imparting torque thereon when pressurized hydraulic fluid is discharged through the orifice into the pockets in angular relation to the radius of the rotor intersecting the pocket.

2. The structure as defined in claim 1, together with bypass means connected with the pump means and a control valve therein for controlling the output characteristics of the pump means.

3. The structure as defined in claim 2 wherein said housing is mounted on a top plate for said tank, said tank including an inlet adapter communicated with the intake of the pump means, and a baffle in said tank to reduce movement of hydraulic fluid therein.

4. The structure as defined in claim 3 wherein said electrical arrangement for powering the electric motor includes a plurality of storage batteries connected in series and connected to a charging device for maintaining a charge in the batteries, said charging device being drivingly connected to said power device, a pair of inverters connected to the batteries to provide an AC output which is connected to a convertor to provide a DC output, and batteries interposed between the positive and negative DC outputs of the convertor and the positive and negative terminals of a DC motor for acting as cushioning devices between the convertor and DC motor.

5. The structure as defined in claim 1 wherein said shoulders on the rotor are disposed radially inwardly of the periphery thereof, said pockets being generally tear drop in configuration and disposed in the periphery of the portion of the rotor received between the ribs on the injector block, said orifice being disposed in the bottom of said channel in alignment with the pockets in the rotor.

* * * * *